United States Patent [19]

Thomas et al.

[11] Patent Number: 4,619,714

[45] Date of Patent: Oct. 28, 1986

[54] CONTROLLED ROLLING PROCESS FOR DUAL PHASE STEELS AND APPLICATION TO ROD, WIRE, SHEET AND OTHER SHAPES

[75] Inventors: Gareth Thomas, Berkeley; Jae-Hwan Ahn, Albany, both of Calif.; Nack-Joon Kim, Laramie, Wyo.

[73] Assignee: The Regents of the University of California, Berkeley, Calif.

[21] Appl. No.: 676,066

[22] Filed: Nov. 29, 1984

Related U.S. Application Data

[63] Continuation-in-part of Ser. No. 638,046, Aug. 6, 1984.

[51] Int. Cl.[4] ..... C21D 7/14; C21D 7/10

[52] U.S. Cl. ..... 148/12 B; 148/12 F; 148/36

[58] Field of Search ..... 148/12 B, 12.4, 12 F, 148/12 R, 36

[56] References Cited

U.S. PATENT DOCUMENTS

| | | | |
|---|---|---|---|
| 3,926,687 | 12/1975 | Gondo et al. | 148/12 B |
| 4,062,700 | 12/1977 | Hayami et al. | 148/12.3 |
| 4,067,756 | 1/1978 | Koo et al. | 148/144 |
| 4,159,218 | 6/1979 | Chatfield et al. | 148/12.4 |
| 4,325,751 | 4/1982 | Josefsson | 148/12.4 |
| 4,376,661 | 3/1983 | Takechi et al. | 148/12.4 |
| 4,406,713 | 9/1983 | Yutori et al. | 148/12 B |
| 4,407,680 | 10/1983 | Gladman et al. | 148/12.4 |
| 4,421,573 | 12/1983 | Irie et al. | 148/12.4 |
| 4,466,842 | 8/1984 | Yada et al. | 148/36 |
| 4,502,897 | 3/1985 | Morita et al. | 148/36 |
| 4,533,401 | 8/1985 | Yutori et al. | 148/12.4 |

FOREIGN PATENT DOCUMENTS

| | | | |
|---|---|---|---|
| 3312257 | 10/1983 | Fed. Rep. of Germany . | |
| 56121 | 5/1978 | Japan | 148/12.4 |
| 177919 | 1/1982 | Japan | 148/12 B |
| 81928 | 5/1983 | Japan | 148/12 B |

OTHER PUBLICATIONS

Kim, Nack-Joon, LBL-12661, "Design of Dual-Phase Fe/Mn/C Steel for Low Temperature Application", 9/1981.

DOE/TIC/EG, *Dual-Phase Steel for Low-Temperature Application,* Technical Note, Technical Information Center, U.S. Dept. of Energy, Oak Ridge, Tennessee, DOE/TIC/EG-82/261.

Kim, N.J. et al., *Dual-Phase Steel for Pipelines,* Int. Conf. on "Steels for Pipe and Pipeline Fittings", The Metals Society, London, Book 285, 121-124 (1983).

*Primary Examiner*—Wayland Stallard

*Attorney, Agent, or Firm*—Flehr, Hohbach, Test, Albritton & Herbert

[57] ABSTRACT

An improved, energy efficient, hot rolling method for direct production of cold formable dual-phase steel is provided. The steel is heated to completely austenitize it and then continuously hot rolled and cooled down into the ferrite-austenite two phase region to a temperature which is just below the effective $Ar_3$ temperature. The hot rolled steel is then rapidly quenched to provide an alloy containing strong, tough lath martensite (fibers) in a ductile soft ferrite matrix. The method is particularly useful for providing rods in which form the alloy is capable of being drawn into high strength wire or the like in a cold drawing operation without any intermediate annealing or patenting, and has excellent strength, ductility and fatigue characteristics.

4 Claims, 3 Drawing Figures r = AUSTENITE
a = FERRITE
Ms = MARTENSITE r = AUSTENITE
a = FERRITE
Ms = MARTENSITE

MPa = ksi/6.89
$d_o$ = STARTING WIRE ROD DIAMETER
d = WIRE DIAMETER AFTER COLD DRAWING

CONTROLLED ROLLING PROCESS FOR DUAL PHASE STEELS AND APPLICATION TO ROD, WIRE, SHEET AND OTHER SHAPES

This invention was made with Government support under Contract No. DE-AC03-76SF00098 awarded by the Department of Energy. The Government has certain rights in this invention.

This is a continuation-in-part of copending Serial No. 638,046 filed Aug. 6, 1984.

The present invention is directed to an improved, energy efficient, hot rolling method for direct production of low carbon dual-phase steel characterized by high strength, high ductility and superior cold formability.

This invention is further directed to utilize those properties to produce high strength wire, rod and other shapes as an alternative to existing practice using medium to high carbon steels. The term "dual-phase steels" used herein refers to a class of steels which consists of ferrite matrix and a dispersed second phase such as lath martensite, bainite and/or retained austenite.

There has been an increasing demand for high strength steels in grades covering both structural and automotive applications, which require toughness and superior formability as well. However, a major difficulty is that the properties demanded for these applications have generally been incompatible with steels having conventional microstructures. Therefore, the introduction of the so-called dual-phase steels generated much interest because they provide excellent mechanical properties if the microstructure and morphology are controlled to utilize the principles of composites. A dual-phase steel can be designed to optimize properties by optimizing the component mixture of ferrite and tough lath martensite or bainite. Compared with conventional high strength, low alloy (HSLA) steels, the incorporation of a strong second phase in the soft ferrite matrix forms a composite which has highly desirable mechanical properties (viz., low yield to tensile strength ratios high initial strain hardening rates, continuous yielding behavior, excellent combinations of ultimate tensile strength, ductility, toughness and cold formability). Such characteristics have led dual-phase steels to be regarded as attractive materials, particularly for applications where the high performance in mechanical behavior is needed.

However, the methods heretofore known for developing dual-phase microstructures have involved both thermal and mechanical treatment processes which, in themselves, consume a substantial amount of energy. Such processing methods are described, for example, in U.S. Pat. Nos. 3,423,252, 3,502,514, 4,067,756, 4,062,700, 4,159,218, 4,407,680, 4,376,661, 4,421,573, 4,325,751 and British Pat. No. 1,091,942. There continues to be a need for developing more energy efficient processes for developing the desirable fibrous dual-phase structure.

The primary object of the present invention is to produce a steel which can be cold formed without further heat treatment into high strength, high ductility steel wires, rods and other shapes using a process comprising the step of cold working a dual-phase steel composition to the required strength and ductility under predetermined conditions without intermediate annealings or patenting heat treatments.

It is therefore an object of the present invention to provide an energy-efficient method for producing high strength, high ductility cold formable steel characterized by an ultrafine fibrous ferrite-martensite or ferrite-bainite microstructure.

For example, a common method of producing high strength, high ductility wire is by patenting at near eutectoid composition pearlitic steel.

There is a need for steel wire and rods having better combinations of tensile and fatigue strength and higher ductility than convention steel wire and rods produced by known methods, without involving new capital investment, or unnecessary microalloying elements. The present invention, as contrasted to conventional method of patenting pearlitic steel to produce wire, provides a process whereby an alloy of relatively simple composition can be processed into wire or rods in a single continuous multipass operation, i.e., without intermediate annealing or patenting heat treatments. Elimination of the intermediate patenting heat treatments in the production of high strength steel wire will lower the cost of producing high strength steel wire, e.g., tire cord.

These and other objects will become evident from the following descriptions of the preferred embodiments.

One preferred product produced according to the present invention is a high strength, high ductility, low carbon steel wire, rod or other shape produced from a steel composition characterized by a dual-phase ferrite-lath martensite (bainite) microstructure as described hereinbelow. This composition may vary from plant to plant depending on processing methods, e.g., continuous casting, but in all cases the composition can be designed to meet particular plant requirements.

The present invention may be illustrated by reference to production of rods and wires. From the desired composition, the austenite ($\gamma$) to ferrite and austenite ($\alpha+\gamma$) transformation temperature is determined either by experimental methods such as dilatometry or by calculation (for example, by K. W. Andrews, JISI, 203 (July 1965), 721–727). For transformation during cooling this temperature is the $Ar_3$.

It will be appreciated that the effective transformation temperature is dependent upon the processing conditions under which rolling is conducted during the $\gamma$ to ($\alpha+\gamma$) transition due to the heat and friction of processing. However, the effective transformation will be higher than the measured or calculated transformation temperature $Ar_3$. According to the present invention the final rolling in the finishing block will be down just below effective $Ar_3$ and the final rod will be rapidly quenched from just below effective $Ar_3$ to ambient. Thus, the final rolling and quenching may be conducted at the calculated or measured $Ar_3$, since that point will be lower than the effective $Ar_3$. Quenching causes the austenite to be converted to martensite or bainite, preferably lath martensite in which the carbon content should not exceed 0.4 wt. %, through which a microduplex mixture of ferrite and lath martensite (or bainite) can be obtained. Depending on hardenability and quench rate, the austenite may transform to lath martensite or bainite upon quenching. For optimum cold forming processing, e.g., wire rods, the above processing ensures that the steel can be subsequently cold drawn to the desired diameter and mechanical properties in a single multi-pass operation, without intermediate patenting heat treatments. Similar results apply to plates, sheets or other shapes. The rapid strain-hardening rate of such dual phase steels provides high strength with less cold reduction, than is obtained with conventional steels.

The present invention provides a processing advantage over prior processing methods for batch producing dual-phase steel in that intermediate annealing is eliminated, i.e., an annealing step subsequent to the hot rolling but prior to the cold drawing steps. In addition to reducing the number of processing steps, the present invention thus conserves energy in the processing and thereby reduces costs. The method according to the present invention is particularly applicable to producing rods and wires, but other hot rolled articles such as plates and sheets may also be produced. The dual phase steel so produced can be processed cold into products such as cold heading goods (nuts and bolts), pre-stressed concrete wires, and the like.

Another advantage resides in the fact that the starting steel may be a billet which is formed into a rod-like shape (or other shape depending upon application) during the hot rolling operation. In addition, the desired cross-sectional area of the rod may be tailored to the desired size and shape.

Along with these processing advantages, improvement in the final product is also obtained by the grain refinement that takes during the controlled rolling steps of the invention. This process comprises heating the steel to an optimum soaking temperature, (which should be lower than existing practice for conventional steel and hence saves fuel) defomring above and below the austenite recrystallization temperature, finally deforming just below the $Ar_3$ temperature in the $(\alpha+\gamma)$ region. While not intending to limit the invention by a theoretical explanation, for purposes of clarification, during deformation in the temperature zone $T_2$ of FIG. 1, the austenite grain size is decreased by repeated recrystallization. In the final rolling, however, the austenite is not fully recrystallized but becomes elongated into a fibrous morphology when the alloy is deformed in the $(\alpha+\gamma)$ range. Upon direct quenching, the dual-phase structure is developed wherein the martensite islands are more or less unidirectionally aligned fibers in the ferrite matrix. During wire drawing, load transfer is most efficient when martensite particles are present in the form of fibers than spheres. This is believed to be primarily because the transfer of load occurs by shear acting along the martensite/ferrite interfaces. Thus, for a given volume fraction and the same number of martensite particles, more interfacial area is available in a fibrous morphology.

The preferred morphology produced according to the present invention is therefore a fibrous distribution of lath martensite in the longitudinal direction in a matrix of fine grained ferrite.

Broadly, the present invention is directed to producing high strength, high ductility, low carbon dual-phase steel. The carbon content will be less than 0.4 weight %. The invention is not limited to particular steel compositions, but typically the steel will contain iron from about 0.05 to 0.3% by weight carbon, about 0.2 to 3% by weight silicon and/or about 0.2 to 2.0% by weight manganese. The steel compositions may contain nitrogen in the range of 0 to 0.2 weight %. Usually, the amount of silicon will be at least about 0.2%, and the carbon content will not be greater than about 0.1%.

In addition, carbide forming elements such as, vanadium, niobium, molybdenum may be added, usually in the amounts of 0.05 to 0.15% by weight.

Figure 1:
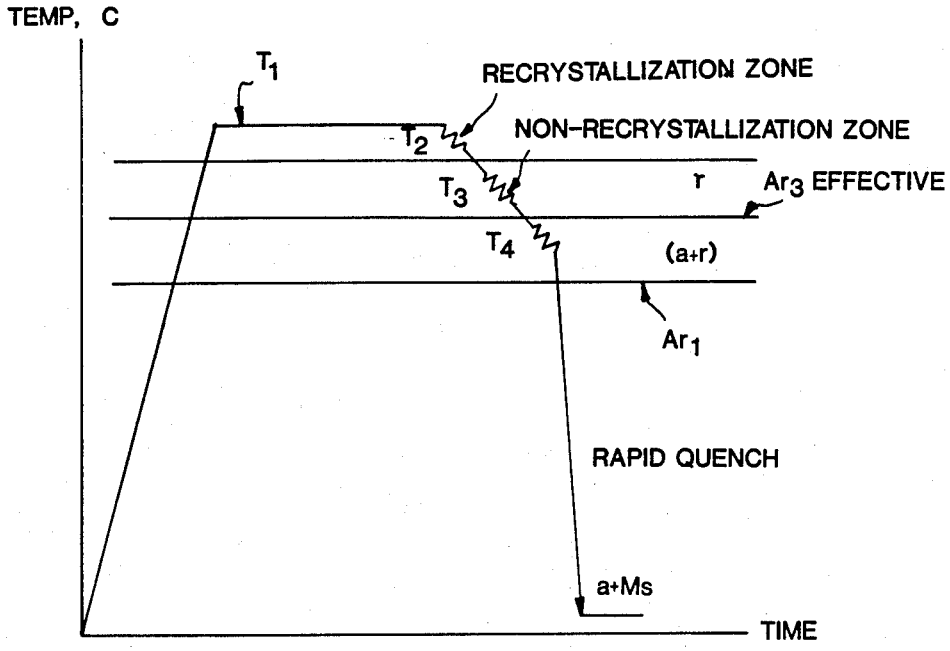
FIG. 1 is a plot of time versus temperature characterizing the processing steps of a preferred embodiment according to the present invention.

The appropriate composition, determined by conventional steel making practice, determines the processing temperatures for the rolling steps. Referring to FIG. 1, the steel will be heated to a temperature $T_1$. While $T_1$ will vary somewhat depending on the composition of the steel, generally $T_1$ will be in the range of about 950° C. to 1200° C.

The composition will be held at that temperature for a period of time sufficient to substantially and completely austenitize the steel. Because of the low carbon the time-temperature will be controlled to avoid decarbonisation. The resulting composition will then be deformed at temperature $T_2$ in the austenite recrystallization region, followed by the deformation in the non-recrystallization region ($\gamma$ region) at a lower temperature $T_3$, which is above the effective $Ar_3$. At the temperature $T_2$, the austenite grains should be refined as small as possible by consecutive deformation and recrystallization. The total reduction in cross-section of the rolled composition in this range will be about 50%. The composition will be deformed at temperature $T_3$ in which austenite grains are elongated producing deformation bands within the grains. The elongated austenite grains and deformation bands provide nucleation sites for austenite-ferrite transformation, thus fine ferrite grain can be obtained. The rolling at this temperature will usually be performed whereby the cross-sectional area of the rolled component will be reduced by at least 30%. Depending upon the composition of the steel, the values of $T_2$ and $T_3$ will generally be in the range of 800° to 1000° C.

Subsequently, as the temperature of the composition falls below the effective $Ar_3$, i.e., into the $(\alpha+\gamma)$ region, the steel will be finish hot rolled at temperature ($T_4$). Temperature $T_4$ will be just below effective $Ar_3$. As discussed above, the calculated or measured value for $Ar_3$ will be lower than effective $Ar_3$ due to the rolling conditions, therefore, it will be satisfactory to use the calculated or measured $Ar_3$ value as temperature $T_4$. Finish hot rolling will usually be performed whereby the cross-sectional area of the rolled component will be again reduced at least by about 30%.

Then the composition will be rapidly quenched from just below effective $Ar_3$ in a liquid, preferably water, to ambient temperature.

Upon final quenching, the austenite transforms to martensite, resulting in a tough strong second phase of lath martensite whose carbon content will be less than 0.4%, dispersed in a ductile ferrite matrix. Such composite has sufficient cold formability to allow cold reductions in cross-sectional areas of up to about 99.9%, without any further heat treatment.

The main advantage of the development of such dual-phase steels by controlled rolling over other processes are (1) much finer ferrite grains can be obtained, (2) a more desirable morphology (fine, fibrous) can be obtained, (3) the more expensive intermediate treatment (e.g., heat treatment) can be deleted, and (4) the appropriate lath martensite or bainite phase can be maintained. Furthermore, the process can be readily used in existing steel milling facilities, including rod, bar or hot strip mills, since, apart from conventional apparatus for controlled temperature and quenching, no significant capital expenditure would be required. Sinmple compositions may also be processed, e.g., Fe/Mr/C, Fe/Si/C or Fe/Si/Mn/C as is illustrated in the following examples.

EXAMPLE 1

A steel bar having a cross-sectional area equal to about a 0.6" diameter rod is treated according to the profile illustrated in FIG. 1. The composition of the steel is iron containing 2% by weight silicon, 0.03% by weight of manganese, 0.08% by weight carbon and traces of impurities. First the bar is heated to 1150° C. for 20 minutes while air cooling, followed by the rolling at 1100° C. providing a 50% reduction in cross-sectional area (Rolling Step 1 in FIG. 1). The bar is hot rolled again starting at 1000° C. and reduced by 30% in cross-sectional area (Rolling Step 2 in FIG. 1). Air cooling is continued throughout the austenite-ferrite transformation. A third reduction of 35% is carried out a 950° C. (Rolling Step. 3 in FIG. 1), i.e., just below $Ar_3$. The rod is water quenched after completing the third reduction and is composed of an ultra-fine mixture of ferrite and fibrous lath martensite.

EXAMPLE 2

The product from Example 1 is surface cleaned, uncoated, lubricated then cold drawn through lubricated tungsten carbide and diamond dies to a diameter of 0.0095" with no intermediate anneals. This wire has a tensile strength of 390 Ksi (2690 MPa) at a diameter of 0.0105".

EXAMPLE 3

The procedure of Example 1 is repeated except that the steel contains 0.1% by weight of vanadium in addition to the other components. The steel rod was cold drawn according to the procedure of Example 2 to a diameter of 0.037" where its tensile strength was 300 Ksi (2070 MPa), and it was also drawn to a diameter of 0.0105" where its tensile strength was 405 Ksi (2790 MPa). Higher tensile strengths may be achieved by continued cold drawing. Stress relieving, as is common in tire cord manufacture may also be accomplished in any of these examples, without deleterious effects.

EXAMPLE 4

A steel bar having a size similar to that of Example 1, but having a composition consisting essentially of iron, 1.5% by weight of manganese, and 0.1% carbon, is soaked for twenty minutes at 1050° C. It is then hot rolled while being allowed to air cool to provide a reduction of 50% in cross-sectional area. It is again hot rolled at about 800° C. to provide a reduction of 30%. The air cooling is continued throughout the ferrite transformation from austenite, and a third reduction (35%) is carried out as the rod reaches a temperature just below $Ar_3$ (~720° C.) and has completed the desired ferrite-austenite composition. The rod is immediately quenched to provide a steel rod consisting of lath martensite in a ferrite matrix.

In order to make wire suitable for tire cord, the rod is then cold drawn to a diameter of 0.0105" and has a strength of 380 Ksi (2620 MPa).

EXAMPLE 5

Figure 2:
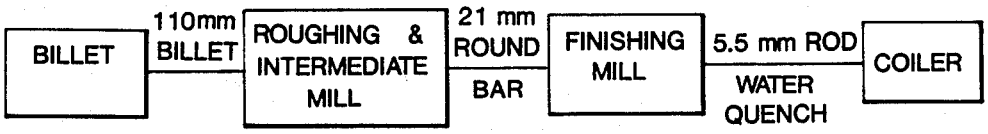
FIG. 2 is a block diagram representing a controlled rolling procedure according to the present invention as adapted for a rod mill to produce a wire rod.

FIG. 2 shows a preferred manufacturing process in block form. For the steel of Example 4, the steel may be heated to 1050° C. to austenize. It then passes through the roughing stand where it is reduced to 21 mm bar at about 800° C. (still in $\gamma$ phase). It is cooled to about 720° C., which is the $(\alpha+\gamma)$ region. It is further reduced to 5.5 mm rod and quenched, resulting in a micro-duplex ferrite and lath martensite structure. The dual-phase rod thus formed is collected on a coiler. The same method will apply to plate, sheet, strip and the like.

EXAMPLE 6

Figure 3:
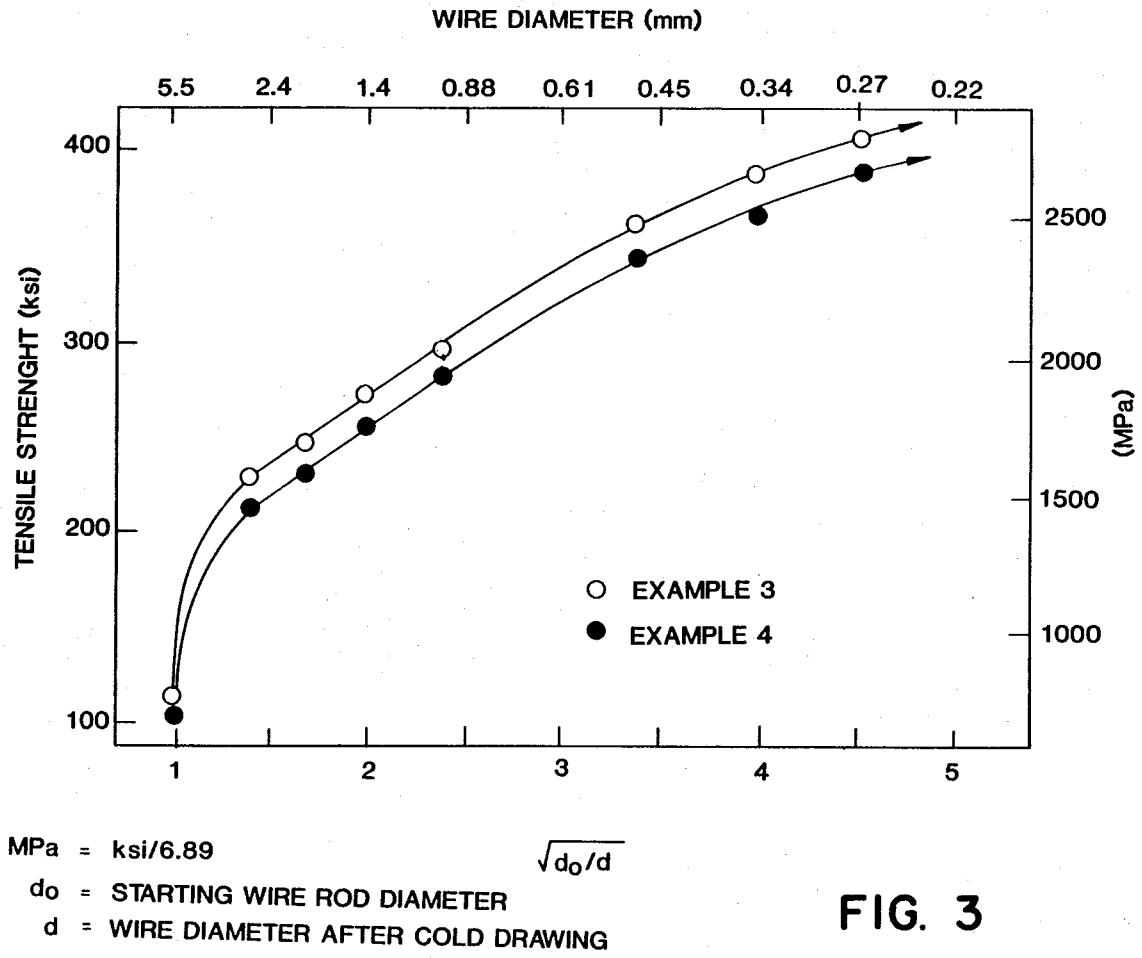
FIG. 3 is a plot of tensile strength versus wire diameter of two steel compositions processed according to the present invention.

A rod produced as described in Example 5 is cold drawn into wire. As the rod is drawn, its tensile strength increases as shown in FIG. 3. A comparison with a wire made as described in Example 3 is also shown in FIG. 3. It can be seen that a range of wire products of required mechanical properties can be directly produced simply be cold drawing, e.g., bead, tire cord, prestressed concrete wire, etc. Thus, wire making is a preferred use of the invention, particularly since no heat treatment subsequent to the initial quenching is required. There may be as much as 99.8% reduction in cross-sectional area and strengths of greater than 400,000 psi are attainable.

EXAMPLE 7

Steel plates and sheets processed according to the description heretofore given for steel rod may be made. The dual-phase steel plate or sheet may be then cold rolled to provide a high strength steel product. Other shapes may be made according to the process of the invention, and the superior cold formability allows cold working not feasible in ordinary steels, while increasing the strength and toughness of the final product.

What is claimed is:

1. In a method for producing a high strength, high ductility steel characterized by an ultra-fine fibrous ferrite-lath martensite microstructure, comprising heating a steel composition at a temperature $T_1$ for a period sufficient to substantially completely austenize said composition;

hot rolling said composition in the austenite recrystallization region at a temperature $T_2$ and further rolling in the non-recrystallization $\gamma$-region at temperature $T_3$; the improvement comprising the steps of rolling said composition at a temperature $T_4$; wherein $T_4$ is a temperature below the effective transition point $Ar_3$, within the $(\alpha+\gamma)$ region, and rapidly quenching said composition to an ambient temperature to convert the austenite to lath martensite.

2. The method according to claim 1 further comprising the step of cold deformation of said composition subsequent to quenching into a shaped product.

3. The method according to claim 2 wherein said product is wire, rod or sheet.

4. A high strength, high ductility steel composition consisting essentially of iron of about 0.05 to 0.3% by weight carbon, about 0.2 to 3% by weight silicon or about 0.2 to 2% by weight manganese and 0 to 0.2% by weight nitrogen, characterized by an ultra-fine fibrous ferrite-lath martensite microstructure, said composition produced according to the process of claim 1.

* * * * *